US006824614B1

(12) United States Patent
Spatafora

(10) Patent No.: US 6,824,614 B1
(45) Date of Patent: Nov. 30, 2004

(54) GUMMING MACHINE

(75) Inventor: Mario Spatafora, Bologna (IT)

(73) Assignee: G.D Societa' per Azioni, Bologna (IT)

( * ) Notice: Subject to any disclaimer, the term of this patent is extended or adjusted under 35 U.S.C. 154(b) by 168 days.

(21) Appl. No.: 10/070,108

(22) PCT Filed: Aug. 31, 2000

(86) PCT No.: PCT/IT00/00350

§ 371 (c)(1),
(2), (4) Date: Jul. 1, 2002

(87) PCT Pub. No.: WO01/15817

PCT Pub. Date: Mar. 8, 2001

(30) Foreign Application Priority Data

Sep. 1, 1999 (IT) ..... BO99A0472

(51) Int. Cl.[7] ..... B05C 1/02

(52) U.S. Cl. ..... 118/203; 118/221; 118/244; 118/255; 118/259; 156/578; 134/170

(58) Field of Search ..... 118/302, 304, 118/313, 323, 401, 203, 221, 244, 255, 259; 156/578, 281; 134/104.1, 170; 427/207.1, 428, 359

(56) References Cited

U.S. PATENT DOCUMENTS 1,976,016 A * 10/1934 Greenough ..... 12/73.5
3,509,853 A * 5/1970 Hartbauer et al. ..... 118/706
3,812,820 A * 5/1974 Ronneberg ..... 118/711
4,210,977 A * 7/1980 Lillibridge ..... 15/306.1
4,395,968 A * 8/1983 Wahnschaff et al. ..... 118/602
4,419,141 A * 12/1983 Kunkel ..... 134/22.12
4,556,447 A * 12/1985 Bradley et al. ..... 156/578
5,367,982 A * 11/1994 DeMoore et al. ..... 118/46

FOREIGN PATENT DOCUMENTS

EP 0 562 888 9/1993
WO WO 88/03844 6/1988

* cited by examiner

*Primary Examiner*—Laura Edwards
(74) *Attorney, Agent, or Firm*—Marshall, Gerstein & Borun LLP

(57) ABSTRACT

A gumming device (1) for applying gum (2) to an article (4), whereby the article (4) is fed along a path tangent to a lateral surface (22) of a gumming disk (13) having an inner chamber (16) communicating with a number of radial feed channels (17) terminating at the lateral surface (22) of the gumming disk (13); the gum (2) is fed under pressure to the inner chamber (16) to wet part of the lateral surface (22) of the gumming disk (13) via the feed channels (17); being provided a supply device (24) for supplying gum (2) under pressure to the feed channel (17) having a pump (41) for the gum (2), at least one supply conduit (25, 28) connecting an output of the pump (41) to the feed channel (17), and a valve (29) for closing the supply conduit (25, 28) which is located along the supply conduit (25, 28) and is carried by the gumming disk (13).

26 Claims, 3 Drawing Sheets

GUMMING MACHINE

TECHNICAL FIELD

The present invention relates to a gumming device.

The present invention may be used to advantage in the gumming of cardboard blanks on a cigarette packing machine, to which the following description refers purely by way of example.

BACKGROUND ART

U.S. Pat. No. 4,736,703 describes a cigarette packing machine on which blanks are fed along a straight path tangent to the lateral surface of a gumming roller rotating at constant speed and having a bottom portion immersed in a bath of gum. Between the bath of gum and the point at which the gum is applied to the blanks, a scraping device provides for evening the thickness of the layer of gum on the lateral surface of the gumming roller, which may have cavities for receiving given quantities of gum. If so, the scraping device is so arranged as to remove substantially all the gum off the lateral surface of the gumming roller, except for the gum inside the cavities, which is only applied to given portions of the blanks.

The above gumming device has several drawbacks. In particular, gumming rollers of the above type are particularly "dirty" and call for frequent cleaning on account of the roller rotating inside the bath of gum; the gum in the bath tends to dry when the machine is stopped, by remaining in contact with the air with no provision for stirring; and roller gumming devices of the above type fail to reproduce the desired gumming pattern accurately, by failure of the scraping device to thoroughly clean the lateral surface portions of the roller corresponding to the gumfree portions of the blank.

To eliminate the above drawbacks, spray gumming devices have been proposed, as described in Patent EP-B1-601411. Such devices, however, have proved relatively expensive and unreliable on account of frequent clogging of the spray nozzles.

Furthermore, to eliminate the above drawbacks gumming devices disclosed in Patent WO-A1-0003814 (which is an earlier patent document, but published after the filing date of the present patent application) and in Patent WO-A1-8803844 were proposed. Patent WO-A1-0003814 and Patent WO-A1-8803844 disclose a gumming devices for applying gum to an article, wherein an article to be gummed is fed along a path tangent to a lateral surface of a gumming disk having an inner chamber communicating with a number of radial feed channels terminating at the lateral surface of the gumming disk; the gum is fed under pressure to the inner chamber to wet part of the lateral surface of the gumming disk via the feed channels.

The gumming devices disclosed in Patent WO-A1-0003814 and Patent WO-A1-8803844 have some drawbacks stemming from the fact that the feeding devices used in the above known gumming devices to fed the gum under pressure to the inner chamber of the relevant gumming disks do not allow controlling in a sufficient precise manner the feeding of the gum to the radial feed channels terminating at the lateral surface of the relevant gumming disks.

DISCLOSURE OF INVENTION

It is an object of the present invention to provide a gumming device designed to eliminate the aforementioned drawbacks, and which is also straightforward and cheap to produce.

According to the present invention, there is provided a gumming device for applying gum to an article as recited in claim 1.

BRIEF DESCRIPTION OF THE DRAWINGS

The invention will now be described by way of example with reference to the accompanying drawings, in which.

BEST MODE FOR CARRYING OUT THE INVENTION

Figure 1:
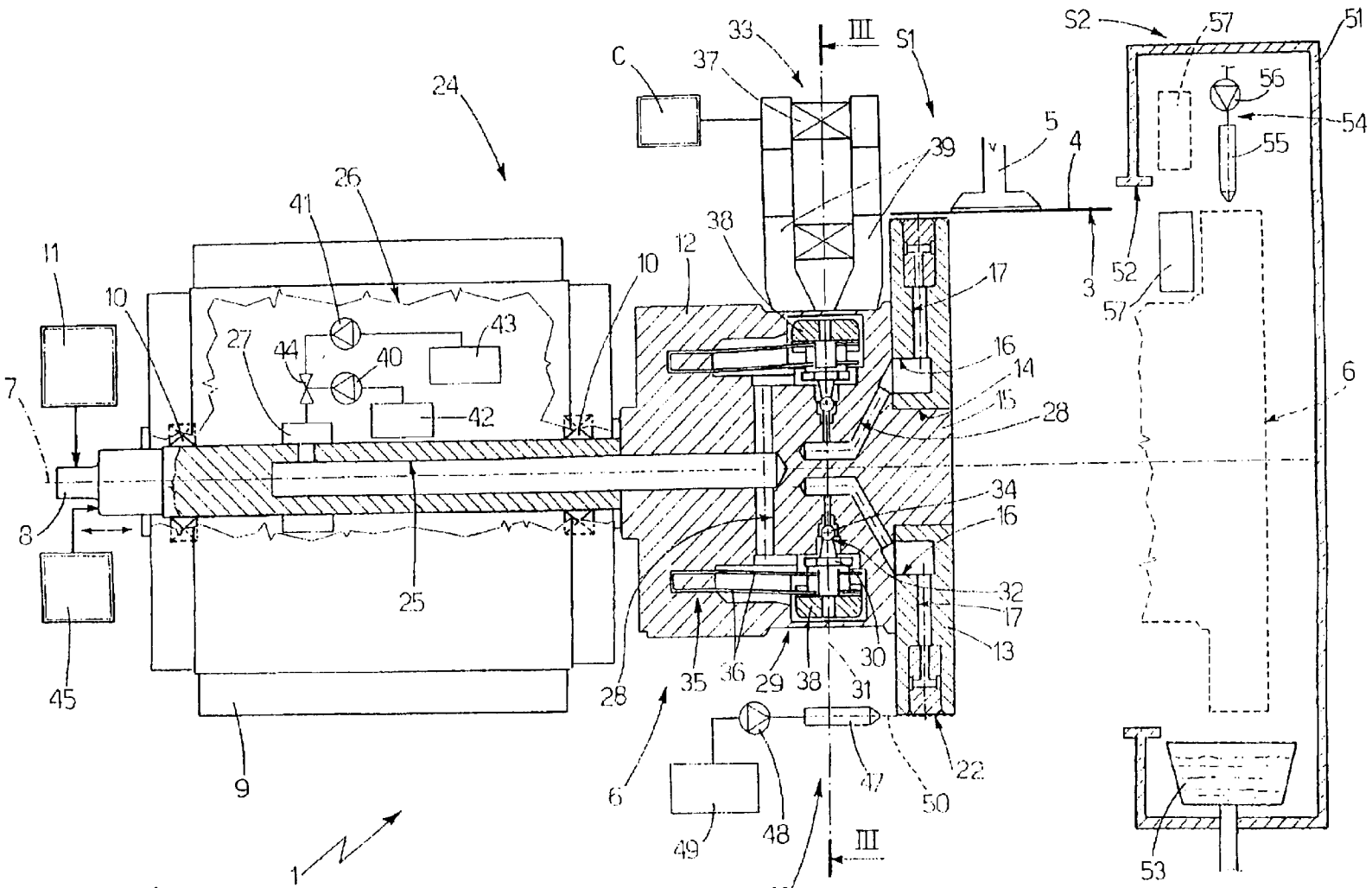
FIG. 1 shows a partial, schematic, partially sectioned side view of a preferred embodiment of the gumming device according to the present invention.

Number 1 in FIG. 1 indicates as a whole a gumming device located at a gumming station S1 and for applying liquid gum 2 (FIG. 2) to the surface 3 of a cardboard blank 4 fed through gumming station S1 by a known suction conveyor 5.

Gumming device 1 comprises a cylindrically symmetrical applicator body 6 having a central axis 7 and fitted to a shaft 8, which is coaxial with axis 7, is fitted to a fixed frame 9 via the interposition of two bearings 10, and is rotated at constant speed about axis 7 by a known motor 11. Applicator body 6 comprises two coaxial, separable elements defined respectively by a drum 12, and by a disk 13 having a central hole 14 coaxial with axis 7 and engaged by a cylindrical pin 15 extending axially from drum 12. Disk 13 and drum 12 are normally connected to each other in known manner (not shown) to prevent any relative movement between drum 12 and disk 13, and in particular to make drum 12 and disk 13 angularly integral with each other.

Figure 2:
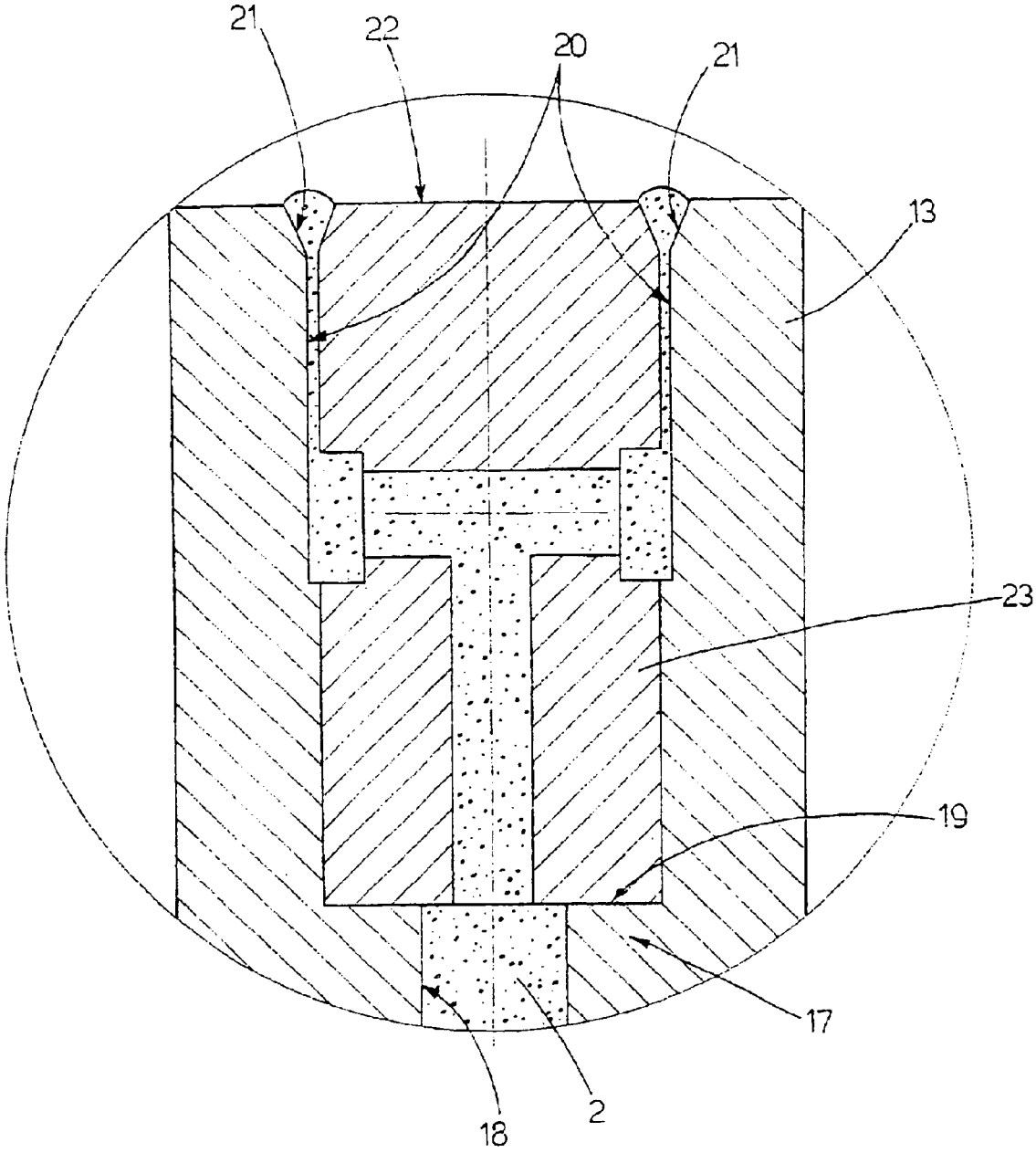
FIG. 2 shows a larger-scale view of a detail in FIG. 1.
Figure 3:
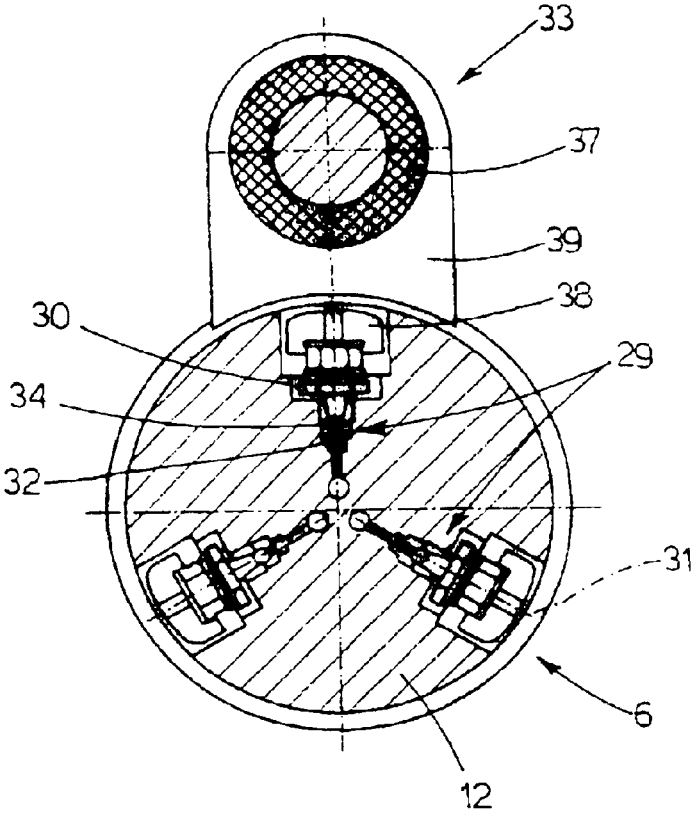
FIG. 3 shows a section along line III—III in FIG. 1.

As shown in FIGS. 1 and 2, three distribution chambers 16 (only two shown in FIG. 1) are defined inside disk 13, close to and equally spaced about axis 7. Inside disk 13, there are also formed three series of channels 17 (only one channel 17 in each series is shown), each series extending substantially radially outwards from a respective chamber 16.

As shown in FIG. 2, each channel 17 comprises an inner portion 18 extending between respective chamber 16 and an outer radial hole 19; and an outer portion 20, which has an annular section, comprises an end portion flaring outwards and communicating with the outside through an annular opening 21 at a cylindrical outer surface 22 of disk 13, and is defined, inside respective hole 19, by a cylindrical plug 23 coaxial with respective hole 19 and of a diameter slightly smaller than the inside diameter of hole 19.

Figure 4:
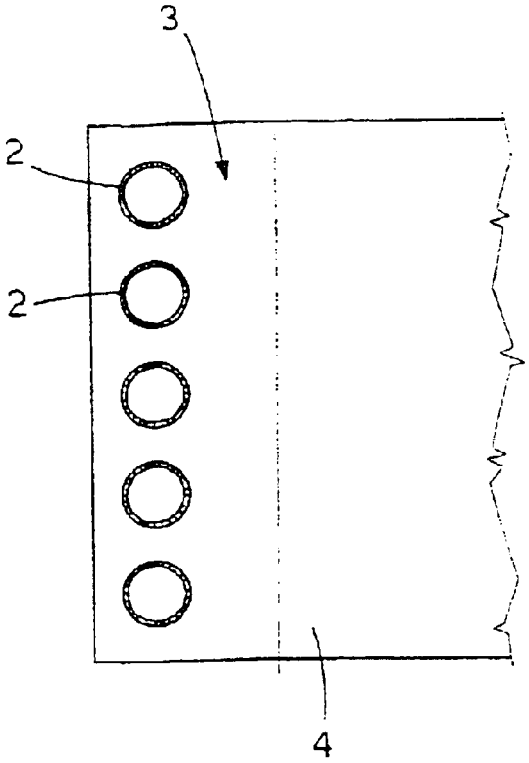
FIG. 4 shows a schematic, larger-scale plan view of a further detail in FIG. 1.

Gumming device 1 comprises a supply device 24 for supplying gum 2 under pressure to chambers 16, and hence to channels 17, so that gum 2 is expelled in controlled manner from openings 21 and deposited onto surface 3 of blank 4 when blank 4 is fed forward by conveyor 5 with surface 3 contacting surface 22. Given the annular shape of openings 21, each channel 17 is able to feed a respective ring of gum 2 (FIG. 4) onto surface 3 of blank 4.

The section of inner portion 18 of each channel 17 is relatively large and greater than that of respective outer portion 20, which, advantageously but not necessarily, defines a capillary channel along which gum 2 is fed substantially by capillarity.

Feeding the gum along each outer portion 20 by capillarity has the advantage of feeding a substantially constant amount of gum 2 along each channel 17, regardless of any variation in the load losses of gum 2 fed along the portions of channels 17 upstream from capillary outer portions 20.

As shown in FIG. 1, supply device 24 supplies gum 2 under pressure to chambers 16, and comprises a main conduit 25 formed inside shaft 8, coaxially with axis 7, and having an inlet end connected to a fixed feeder 26 by means of an annular chamber 27, and an outlet end located inside drum 12 and branching into three secondary conduits 28. Each secondary conduit 28 is connected to a respective chamber 16, and is controlled by a respective valve 29 in turn controlled to cut off secondary conduit 28.

Each valve 29 is a normally-closed valve, and comprises a valve body 30, which is housed inside respective secondary conduit 28 and is moved—with respect to drum 12, in a direction 31 crosswise to axis 7, and by an actuating device 33—from a closed position contacting a respective valve seat 32. More specifically, valve body 30 comprises a spherical sealing member 34, which engages respective valve seat 32 in fluidtight manner when valve body 30 is in the closed position.

Each valve body 30 is connected to drum 12 by a respective articulated parallelogram 35 comprising two metal leaf springs 36, each fixed at one end to drum 12 and at the opposite end to valve body 30. Articulated parallelogram 35 is so arranged as to be elastically deformed at rest, and to exert a given force to keep respective valve body 30 in said closed position when no opening thrust is generated by actuating device 33.

Valve body 30 is thus supported and centered by leaf springs 36, which together form articulated parallelogram 35. This solution is particularly advantageous—as compared with mounting valve body 30 on prismatic guides—by greatly reducing the friction generated by the movement of valve body 30.

Actuating device 33 is located in a fixed position outside drum 12, and comprises a known electromagnet 37 (shown schematically) for generating a magnetic field acting on drum at valve bodies 30, each of which comprises an outer portion 38 made of ferromagnetic material. In actual use, a control unit C activates electromagnet 37 to generate a magnetic field, which acts on drum 12 and draws a valve body 30—located close to actuating device 33—outwards of drum 12 in control direction 31 and into the open position in opposition to respective articulated parallelogram 35.

In the preferred embodiment shown in the accompanying drawings, electromagnet 37 comprises two arc-shaped field poles 39 located close to the periphery of drum 12 with a relatively small gap; and each valve seat 32 is located close to the periphery of drum 12 so that ferromagnetic portion 38 of respective valve body 30 is a relatively small distance from the periphery of drum 12. The above provisions enable each valve 29 to be activated by a relatively low-power electromagnet 37.

Feeder 26 is housed inside fixed frame 9, and comprises two pumps 40 and 41 connected respectively to a tank 42 of water and to a tank 43 of gum 2. Pumps 40 and 41 are connected to chamber 27 by a known three-way valve 44 for supplying conduit 25 with pressurized gum 2 or pressurized water.

In actual use, applicator body 6 is rotated about axis 7 by motor 11, and pump 41 is activated to feed gum 2 under pressure from tank 43 to main conduit 25, from which gum 2 is fed under pressure to secondary conduits 28. Electromagnet 37 is then activated to generate said magnetic field and open each valve 29 travelling beneath electromagnet 37. As each valve 29 is opened, pressurized gum 2 is fed into respective chamber 16 and from chamber 16 to respective channels 17 and respective openings 21 at lateral surface 22 of disk 13. As surface 3 of a blank 4 is brought into contact with surface 22 by conveyor 5, the gum 2 inside openings 21 is deposited onto surface 3 to gum blank 4.

In the preferred embodiment shown in the accompanying drawings, gumming device 1 comprises a known actuating device 45 for moving applicator body 6, along axis 7, between a work position (shown by the continuous line in FIG. 1) in which disk 13 is located at gumming station S1 and cooperates with conveyor 5 to gum blank 4, and a cleaning position (shown by the dash line in FIG. 1) in which disk 13 is located at a cleaning station S2.

Gumming device 1 also comprises a cleaning device 46 located at gumming station S1 and for cleaning surface 22 of disk 13 in said work position. More specifically, cleaning device 46 comprises a nozzle 47 supplied by a pump 48 connected to a tank 49 of water, and which sprays a jet 50 of pressurized water tangentially with respect to surface 22.

Cleaning station S2 has a casing 51 for housing disk 13, and having an opening 52 for inserting and withdrawing disk 13. At the bottom of casing 51, a catch tank 53 is provided for collecting and disposing of the water used to clean disk 13.

Casing 51 also houses a cleaning device 54 for cleaning surface 22 of disk 13 in said cleaning position. More specifically, cleaning device 54 comprises a nozzle 55 supplied by a pump 56 connected to a tank of water (not shown) and for spraying a jet (not shown) of pressurized water perpendicular to surface 22.

Casing 51 also houses an actuating device 57 (shown schematically) identical with actuating device 33 and for cyclically opening valves 29 when disk 13 is in the cleaning position inside casing 51. Actuating device 57 is preferably movable between a work position (shown by the continuous line in FIG. 1) in which actuating device 57 is located close to drum 12 to activate valves 29, and a rest position (shown by the dash line in FIG. 1) in which actuating device 57 is located clear of opening 52 to permit insertion and withdrawal of disk 13 in and out of casing 51.

In an alternative embodiment not shown, actuating device 57 features a permanent magnet as opposed to an electromagnet.

In actual use, to clean surface 22 rapidly, cleaning device 46 is used, which operates with a relatively high-pressure jet 50 (nearly 200 atmospheres) and therefore provides for cleaning surface 22 with a small amount of water.

For thorough cleaning of gumming device 1 as a whole, disk 13 is moved by actuating device 45 into the cleaning position, in which feeder 26 supplies pressurized water to conduit 25 (and therefore to conduits 28, valve seats 32, chambers 16 and channels 17), and, at the same time, surface 22 is cleaned by the jet (not shown) emitted by cleaning device 54. More specifically, by virtue of actuating device 57 and the rotation of applicator body 6 about axis 7, valves 29 are opened cyclically at cleaning station S2 to enable pressurised water to flow into valve seats 32 and respective chambers 16.

In an alternative embodiment, for more thorough cleaning, cleaning substances are added to, or a different cleaning fluid substituted for, the water. To change the form of the rings of gum 2 applied to surface 3 of blank 4, disk 13 shown in the accompanying drawings may be replaced by a different disk (not shown) similar to disk 13 but with differently shaped openings 21.

What is claimed is:

1. A gumming device for applying gum (2) to an article (4); the gumming device (1) comprising an applicator body (6), which has a central axis (7), is cylindrically symmetrical with respect to the central axis (7), and has a lateral surface comprising an application surface (22) which comes into contact with said article (4) to apply said gum (2) to the article (4), drive means (11) for rotating said applicator body (6) about said central axis (7), at least one channel (17) extending inside said applicator body (6) and having an end opening (21) at said application surface (22), and supply means (24) for supplying said gum (2) under pressure to said channel (17); said supply means (24) comprising a pump (41) for said gum (2), at least one supply conduit (25, 28) connecting an output of said pump to said channel (17), and a valve (29) for closing the supply conduit (25, 28), which is located along said supply conduit (25, 28) and is carried by said applicator body (6); wherein said channel (17) comprises at least one capillary portion (20).

2. A gumming device as claimed in claim 1, wherein said supply means (24) comprise an actuating device (33) for actuating said valve (29) to and from a closed position closing said supply conduit (25, 28); said actuating device (33) being located in a fixed position outside said applicator body (6).

3. A gumming device as claimed in claim 1, wherein said valve (29) comprises a valve seat (32) for the passage of said gum (2), a movable valve body (30), and an actuating device (33) for moving said movable valve body (30), in a control direction (31) crosswise to said central axis (7), to and from a closed position closing said valve seat (32).

4. A gumming device as claimed in claim 3, wherein said actuating device (33) is located in a fixed position outside said applicator body (6); said valve body (30) comprising at least one portion (38) of ferromagnetic material; and said actuating device (33) comprising generating means (37) for generating a magnetic field.

5. A gumming device as claimed in claim 3, wherein said valve (29) comprises an articulated parallelogram (35) connecting said valve body (30) to said applicator body (6); said articulated parallelogram (35) keeping the valve body (30) in said closed position in the absence of an opening thrust generated by said actuating device (33).

6. A gumming device as claimed in claim 1, wherein said capillary portion (20) is an outlet end portion of said channel (17).

7. A gumming device as claimed in claim 1, wherein said applicator body (6) comprises a cylindrical drum (12) coaxial with said central axis (7); and a gumming disk (13), which is coaxial with said central axis (7), is connected removably to said cylindrical drum (12) to rotate with the cylindrical drum (12) about said central axis (7), and has a cylindrical lateral surface (22) coaxial with said central axis (7) and defining said application surface (22).

8. A gumming device as claimed in claim 1, and comprising a number of said channels (17), each defined inside said applicator body (6) and terminating with a respective said opening (21).

9. A gumming device as claimed in claim 8, wherein said supply means (24) comprise, for each said supply conduit (25, 28), a respective valve (29) located along the respective supply conduit (25, 28) and controllable to cut off the supply conduit (25, 28).

10. A gumming device as claimed in claim 1, and comprising a cleaning device (46) acting on said application surface (22); said cleaning device (46) comprising at least one nozzle (47) for spraying a jet (50) of pressurized cleaning fluid tangentially with respect to said application surface (22).

11. A gumming device as claimed in claim 1, wherein said supply means (24) comprise a first tank (43) for said gum (2); a second tank (42) for a cleaning fluid; and valve means (44) for selectively connecting said two tanks (42, 43) to said channel (17).

12. A gumming device as claimed in claim 1, and comprising actuating means (45) for moving said applicator body (6) between a gumming station (S1), for applying said gum (2) to said article (4), and a cleaning station (S2).

13. A gumming device as claimed in claim 12, wherein said cleaning station (S2) comprises a further cleaning device (54) acting on said application surface (22); said further cleaning device (54) comprising at least one nozzle (55) for spraying a jet of pressurized cleaning fluid radially with respect to the application surface (22).

14. A gumming device for applying gum (2) to an article (4); the gumming device (1) comprising an applicator body (6), which has a central axis (7), is cylindrically symmetrical with respect to the central axis (7), and has a lateral surface comprising an application surface (22) which comes into contact with said article (4) to apply said gum (2) to the article (4), drive means (11) for rotating said applicator body (6) about said central axis (7), at least one channel (17) extending inside said applicator body (6) and having an end opening (21) at said application surface (22), and supply means (24) for supplying said gum (2) under pressure to said channel (17); said supply means (24) comprising a pump (41) for said gum (2), at least one supply conduit (25, 28) connecting an output of said pump to said channel (17), and a valve (29) for closing the supply conduit (25, 28), which is located along said supply conduit (25, 28) and is carried by said applicator body (6); said valve (29) comprising a valve seat (32) for the passage of said gum (2), a movable valve body (30), and an actuating device (33) located in a fixed position outside said applicator body (6) for moving said movable valve body (30), in a control direction (31) crosswise to said central axis (7), to and from a closed position closing said valve seat (32); wherein said valve body (30) comprising at least one portion (38) of ferromagnetic material, and said actuating device (33) comprising generating means (37) for generating a magnetic field.

15. A gumming device as claimed in claim 14, wherein said valve (29) comprises an articulated parallelogram (35) connecting said valve body (30) to said applicator body (6); said articulated parallelogram (35) keeping the valve body (30) in said closed position in the absence of an opening thrust generated by said actuating device (33).

16. A gumming device as claimed in claim 14, wherein said channel (17) comprises at least one capillary portion (20).

17. A gumming device as claimed in claim 14, wherein said capillary portion (20) is an outlet end portion of said channel (17).

18. A gumming device as claimed in claim 14, wherein said applicator body (6) comprises a cylindrical drum (12) coaxial with said central axis (7); and a gumming disk (13), which is coaxial with said central axis (7), is connected removably to said cylindrical drum (12) to rotate with the cylindrical drum (12) about said central axis (7), and has a cylindrical lateral surface (22) coaxial with said central axis (7) and defining said application surface (22).

19. A gumming device as claimed in claim 14, and comprising a number of said channels (17), each defined inside said applicator body (6) and terminating with a respective said opening (21).

20. A gumming device as claimed in claim 19, wherein said supply means (24) comprise, for each said supply conduit (25, 28), a respective valve (29) located along the respective supply conduit (25, 28) and controllable to cut off the supply conduit (25, 28).

21. A gumming device as claimed in claim 14, and comprising a cleaning device (46) acting on said application surface (22); said cleaning device (46) comprising at least one nozzle (47) for spraying a jet (50) of pressurized cleaning fluid tangentially with respect to said application surface (22).

22. A gumming device as claimed in claim 14, wherein said supply means (24) comprise a first tank (43) for said gum (2); a second tank (42) for a cleaning fluid; and valve means (44) for selectively connecting said two tanks (42, 43) to said channel (17).

23. A gumming device as claimed in claim 14, and comprising actuating means (45) for moving said applicator body (6) between a gumming station (S1), for applying said gum (2) to said article (4), and a cleaning station (S2).

24. A gumming device as claimed in claim 23, wherein said cleaning station (S2) comprises a further cleaning device (54) acting on said application surface (22); said further cleaning device (54) comprising at least one nozzle (55) for spraying a jet of pressurized cleaning fluid radially with respect to the application surface (22).

25. A gumming device for applying gum (2) to an article (4); the gumming device (1) comprising an applicator body (6), which has a central axis (7), is cylindrically symmetrical with respect to the central axis (7), and has a lateral surface comprising an application surface (22) which comes into contact with said article (4) to apply said gum (2) to the article (4), drive means (11) for rotating said applicator body (6) about said central axis (7), at least one channel (17) extending inside said applicator body (6) and having an end opening (21) at said application surface (22), and supply means (24) for supplying said gum (2) under pressure to said channel (17); said supply means (24) comprising a pump (41) for said gum (2), at least one supply conduit (25, 28) connecting an output of said pump to said channel (17), and a valve (29) for closing the supply conduit (25, 28), which is located along said supply conduit (25, 28) and is carried by said applicator body (6); 14); wherein the gumming device (1) comprising actuating means (45) for moving said applicator body (6) between a gumming station (S1), for applying said gum (2) to said article (4), and a cleaning station (S2).

26. A gumming device as claimed in claim 25, wherein said cleaning station (S2) comprises a further cleaning device (54) acting on said application surface (22); said further cleaning device (54) comprising at least one nozzle (55) for spraying a jet of pressurized cleaning fluid radially with respect to the application surface (22).

* * * * *